US007086578B2

(12) United States Patent
Tallevi et al.

(10) Patent No.: US 7,086,578 B2
(45) Date of Patent: Aug. 8, 2006

(54) SECONDARY BEVERAGE CARTON

(75) Inventors: Jeremy Peter Tallevi, London (CA); Keith Lawrence Goodfellow, Toronto (CA)

(73) Assignee: Labatt Brewing Company Limited, London (CA)

( * ) Notice: Subject to any disclaimer, the term of this patent is extended or adjusted under 35 U.S.C. 154(b) by 0 days.

(21) Appl. No.: 10/739,184

(22) Filed: Dec. 19, 2003

(65) Prior Publication Data

US 2004/0159698 A1 Aug. 19, 2004

(30) Foreign Application Priority Data

Dec. 19, 2002 (CA) ..... 101652
Jan. 24, 2003 (CA) ..... 2417290

(51) Int. Cl.
*B65D 5/72* (2006.01)

(52) U.S. Cl. ..... 229/115; 221/302; 221/305; 229/112; 229/122.1

(58) Field of Classification Search ..... 229/112, 229/115, 122.1, 122; 206/427; 221/302, 221/305
See application file for complete search history.

(56) References Cited

U.S. PATENT DOCUMENTS

| | | | | |
|---|---|---|---|---|
| 1,814,561 | A * | 7/1931 | Krumm | 229/115 |
| 2,012,063 | A * | 8/1935 | Unger | 229/115 |
| 2,022,721 | A * | 12/1935 | Hompe | 229/112 |
| 2,067,749 | A * | 1/1937 | Zimmerman et al. | 221/305 |
| 2,624,456 | A * | 1/1953 | Taylor | 221/302 |
| 2,935,192 | A * | 5/1960 | De Million-Czarnecki | 229/115 |
| 3,361,329 | A * | 1/1968 | Fox | 229/122 |
| 3,493,104 | A * | 2/1970 | Tempelhof | 229/115 |
| 3,730,418 | A * | 5/1973 | Spencer | 229/122 |
| 3,894,681 | A | 7/1975 | Arneson et al. | |
| 3,944,128 | A | 3/1976 | Hogan | |
| 4,364,509 | A | 12/1982 | Holley, Jr. et al. | |
| 4,492,333 | A * | 1/1985 | Roberts | 229/115 |
| 4,752,029 | A * | 6/1988 | Buford | 229/122.1 |
| 5,505,304 | A * | 4/1996 | Broskow et al. | 206/427 |
| 5,522,538 | A * | 6/1996 | Gray | 229/112 |
| 5,558,224 | A * | 9/1996 | Fogle | 206/427 |
| 6,360,941 | B1 * | 3/2002 | Larsson | 229/115 |
| 6,478,216 | B1 | 11/2002 | Wiart | |

FOREIGN PATENT DOCUMENTS

EP 524319 A1 * 1/1993

* cited by examiner

*Primary Examiner*—Gary E. Elkins

(57) ABSTRACT

A secondary beverage carton which has two opposing non-rectangular, preferably triangular, side walls. The carton has at least one coincident acute angle. The side walls are connected by end walls. Preferably one end wall has a can access panel which is severable to provide an opening for the cans.

8 Claims, 10 Drawing Sheets

SECONDARY BEVERAGE CARTON

FIELD OF THE INVENTION

The present invention relates to packaging and more particular, to article carriers such as cartons enclosing a plurality of articles such as beverage filled cans or the like; especially cartons having a non-traditional shape.

BACKGROUND ART

In the packaging of articles, such as canned beer, soft drinks and the like, various types of carriers have been employed, generally in the form of cartons, with provision for accepting a predetermined number of the cans, for example, six, eight or twelve, arranged in row formation. The prior cartons have almost invariably had, and continue to have, rectangular walls and hence are generally cubic in appearance. Consequently, beverage producers such as brewers must rely only on carton decoration to differentiate their products from those of others. One type of such packaging container or carrier which has been employed has been in the form of an open ended tube or sleeve with provision for retaining the cans against excessive movement therein or accidental removal through the open ends. In another packaging arrangement tubular packaging containers have been provided which have some means for closing the ends, either wholly or in part, so as to confine the cans and prevent accidental removal from the package. Where end and also top panel closures have been employed, sealing, generally with hot melt adhesives, has generally proven to be costly in terms of material and the skilled labour required. In addition, there are known in the art, many examples of beverage cartons which have an article dispenser arrangement for providing access through an opening from which articles in the carton may be removed. For example, U.S. Pat. Nos. 3,894,681; 4,364,509; 5,368,196 and 6,478,219 described cartons which provide a tear strip to gain access to the articles in the carton. Such an arrangement has a number of disadvantages. For example, during use, the board material surrounding the opening formed by removal of a tear strip usually from an end and a side wall often tears, assuming the lines of perforation function correctly in first place. Problems also arise because the tear strip includes part of both a side wall and an associated end wall and this can cause loss of structural rigidity which can cause problems when the carton is reused to return the empty carton to a recycling facility. Another example of cartons having an article dispensing features include that described in U.S. Pat. No. 3,944,128 where provision is made for part of a center wall to angle outwardly from its associated vertical wall so as to form a spout or trough through which articles can be extracted. This is a relatively complex and expensive system and can have difficulties with heavy articles such as beverage-filled cans. Other examples of this type include cutouts in the side walls adjacent the trough to allow an article to be extracted.

Finally, the tab used in these cartons to initiate the tear sequence to form the strip or trough is often not convenient to use. Usually this tab is pressed into the carton to enable it subsequently to be grasped and pulled. However, the initial pressing step frequently results in the carton walls deforming and tearing but not along the desired lines. Finally, the initial pushing of the tab action may be hindered or even rendered ineffective by the shape and location of the carton contents. In summary, the prior cartons have generally left something to be desired and have proven to be inconvenient and unreliable.

It is an objective of the present invention to provide a secondary carton for containing a plurality of primary containers which container has two opposing side walls which are not rectangular and as a consequence, the carton is conspicuous and stands out from the usual rectangular shaped cartons containing competitive products.

It is another objective of the present invention to provide a container which has an improved convenient dispensing feature for the enclosed primary containers.

SUMMARY OF INVENTION

It has now be found that a secondary carton for containing a plurality of primary containers such as beverage filled cans, which secondary carton has two opposing non-rectangular side walls having at least one coincident acute angle and connected by end walls has an irregular shape which not only provides increased consumer visibility but also flexibility as to product configurations. Furthermore, in a closed carton where the side walls have at least one acute angle, the juncture or join of the associated base or bottom wall and end wall which connect the two side walls result in the end wall being inclined to the vertical. Providing an access port or opening in said end wall at, or preferably slightly spaced from, the join thereof with the bottom wall creates a can dispensing means through which cartons may be conveniently accessed and removed without requiring deformation of the carton side walls to provide part of the opening.

Because of inclined nature of the end wall, the can or the like article in the carton adjacent that wall upon said opening being formed becomes sufficiently exposed to be easily grasped and removed.

The carton can have opposing walls of various shapes e.g. trapezoid, such as a triangle having its upper part cut off by a line parallel to the base or a rectangle where one pair of adjacent right angles is replaced by an acute angle and an obtuse angle pair.

The angle between the end wall and its associated bottom wall can vary and depends on various factors including the size and shape of the articles to be enclosed in the carton and the configuration they are to assume in the carton. It is preferred however that the carton has two opposing side walls which are each triangular and that these are joined together by three end walls, one of which constitutes a base wall. Further, it is especially preferred that the triangles are isosceles or equilateral, the latter having three acute angles of 60° each at the two end wall-to-bottom wall and are end wall to end wall joins. For example, in the specific case of a triangular carton of the present invention which is to enclose 15–355 ml cans of beer, a pyramidal formation i.e. having rows of 5, 4, 3, 2 and 1 cans, with 5 being at the base, would result in a carton having three angles of 60° each, each side wall being an equilateral triangle having sides of about 35 cm. However, similar cartons to enclose more or less of the cans may need to be dimensioned accordingly and present several options. For example, a triangular carton for containing say nine such cans in a single 4, 3, 2 formation could have a base of about 38 cm; and end wall of about 32 cm and a width of about 26 cm (i.e. one can width). This carton would leave a volume in the top apex of the carton free to locate a premium or the like. In this case, it may be preferable to locate an inner "wall" between the opposing end walls parallel to the base wall, above and adjacent the top two cans.

Alternatively, the top apex part of the carton can be eliminated, replaced by a top wall parallel to the base wall of length equal to about two can diameters. In other words, the carton would then have a side wall the shape of a trapezium.

A port or opening can be located in an end wall preferably a short distance from the join of the end wall and the bottom wall so as to leave a small horizontal strip of board material extending across the width of the end wall. A can or like article at the port is then prevented from simply rolling out of the carton by that strip but is readily available due to the angled end wall to be grasped and removed by being lifted out. In view of the stacking arrangement of the cans and the pressure extended by the upper layers thereof, removal of one can automatically results in its place being taken by another until there are only five left in a single row and a slight lift of the carton from back to front would result in those being presented to the user one at a time.

Initially, the port or opening is sealed by a can access panel which is adapted to be readily severed to create the opening and provide access to the enclosed cartons. Preferably, the panel is not fully severed but remains hingedly attached so as to be able to re-seal the opening if desired. This would, for example, assist in retaining the beverage in the cans remaining in the carton cool if the carton is not maintained in a fridge or similar cool environment.

In a further embodiment, the carton of the invention is adapted to accommodate two "banks" of stacked cans with an end of each can in one bank being located adjacent an end of a can in the adjacent bank. The interior of the carton may be constituted as a single compartment or may be divided into two by way of partition means such as a dividing wall. In a further embodiment, such a two-compartment carton is adapted to be severable into two individual cartons. Each of the two backs may have its own can access port, especially when the basic carton is severable into two individual cartons.

The cartons of the present invention may be produced from a one-piece blank of paperboard, preferably corrugated board for strength. Upon being erected, the various walls and the like of the blank may be secured in position using adhesives. However, it may be preferably because of the irregular shapes of the cartons to have the carton secured in its erected condition via mechanical locking means such as a series of tab and slot locking combinations, or a combination whereby the carton is partially pre-glued to form a blank which is set up, filled with cans and mechanically locked.

It is also preferred to have the base or bottom wall constructed of multiple plies of material, again to provide additional strength and ensure structural rigidity and prevent any tendency for the carton base to bow despite the weight of the contents. A modification of the basic blank of the present invention therefore involves providing mechanical locking means to secure the multiply ply base together, these means comprising least one rotatable tab formed in the outermost ply of the base and adapted to extend through at least the adjacent ply and bend around so as to lie thereon and be covered by one more ply. Essentially, this creates a "sandwich" with the tab grasped between the outer and an inner ply of the carton base and held in place by the weight of the carton contents lying on the innermost ply of the base.

Another form of mechanical lock may be used especially to secure non-base side and end walls together, this comprising a tab adapted to enter an associated slot such that when the carton is being carried in the usual manner, a force is extended between an edge of said tap and an edge of its associated slot thereby providing a strong frictional engagement there-between. The latter is enhanced by further providing said slot of an end which the tab engages with a further slot extending at an angle to said first slot thus presenting a V-shape in the board for the edge of the tab to engage.

As the container of the present invention will in most circumstances, be transported in bulk using a standard palleting system, the size of the pallet relative to the size and shape of the carton is of importance if optimum transporting efficiency is to be achieved. A standard Canadian brewery pallet measures 48"×40" (122 cm×100 cm) and consequently optimum utilization of the pallet area would be achieved if the carton size and shape is such that if a plurality of the cartons when assembled in a rectangular configuration in a layer would, if possible, approximate the area of the pallet. In the carton embodiment described above, that is, a carton to enclose 15 355 ml standard beer cans, which carton has a base of about 30 cm and a height of about 20 cm, a layer of cartons comprising 42 cartons would form a block about 120 cm by 120 cm which indicates excellent utilization of pallet space. Each pallet would support between 9 and 11 such layers.

DESCRIPTION OF THE DRAWINGS

The present invention will be further described but not limited by reference to the accompanying drawings in which.

Figure 2:
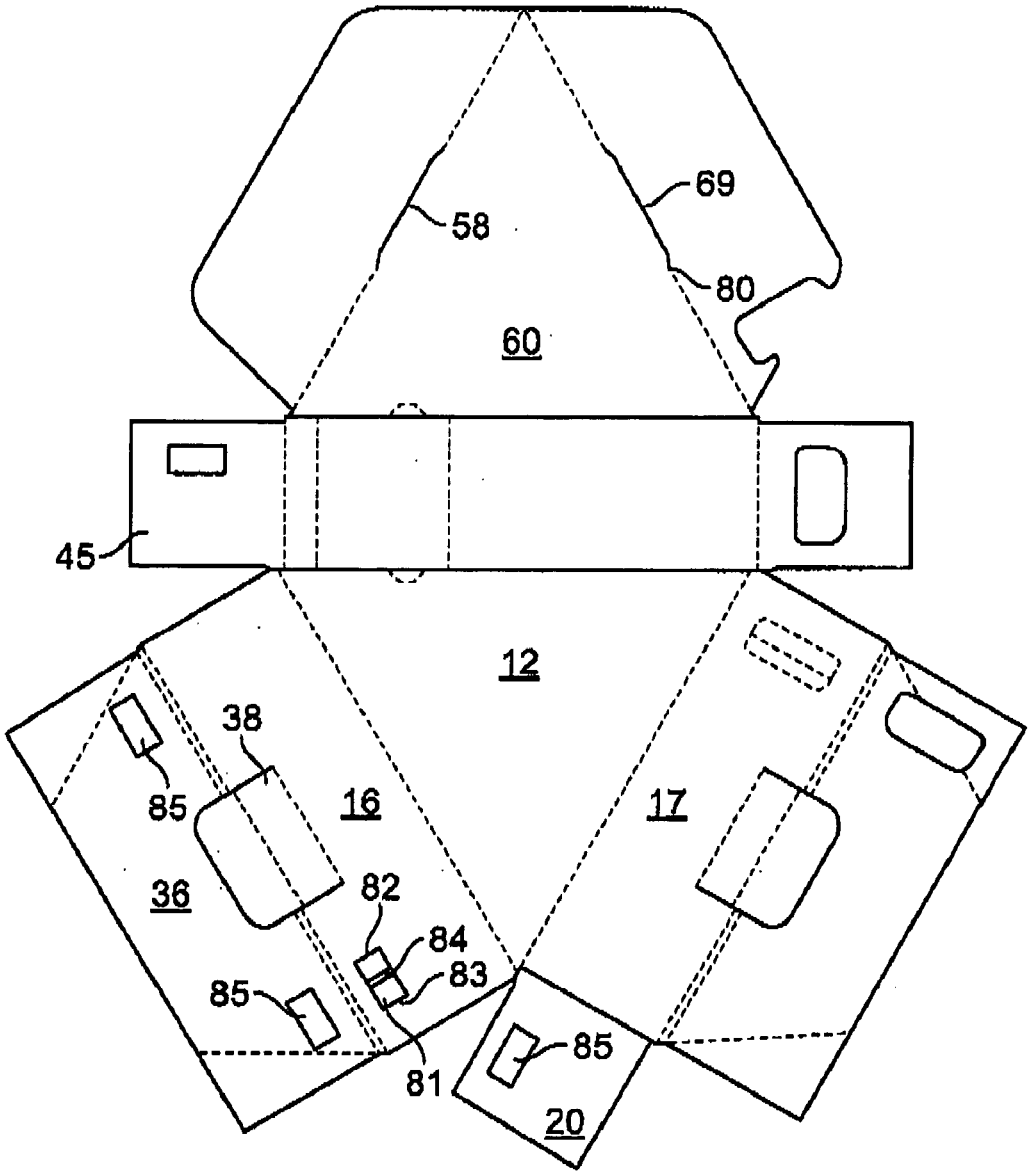
FIG. 2 is a modified embodiment of the blank of FIG. 1 having additional mechanical locking means.
Figure 3:
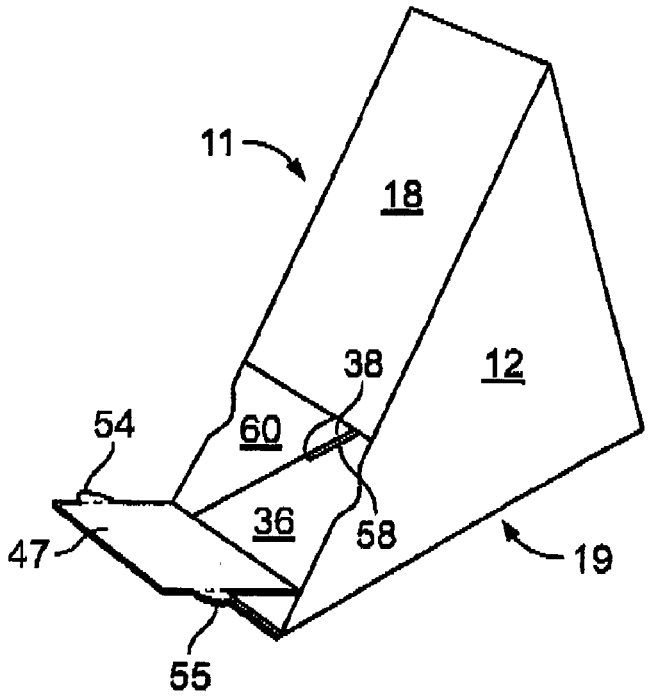
FIG. 3 is a perspective view of a fully erected carton of the present invention formed from the blank of FIG. 1 with its can access panel in an open condition showing the can access opening.
Figure 4:
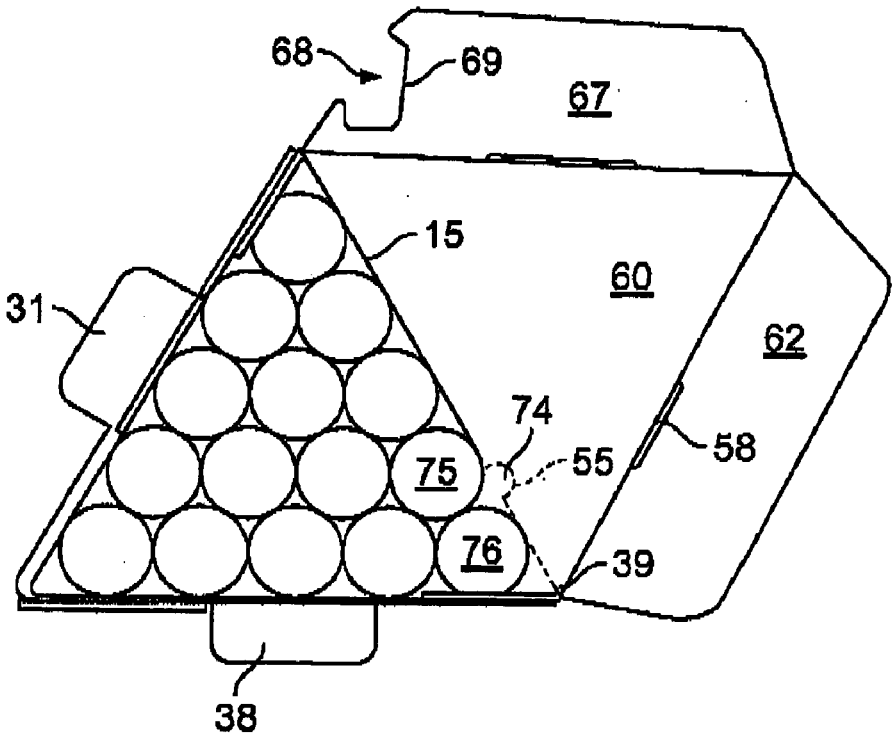
Figure 5:
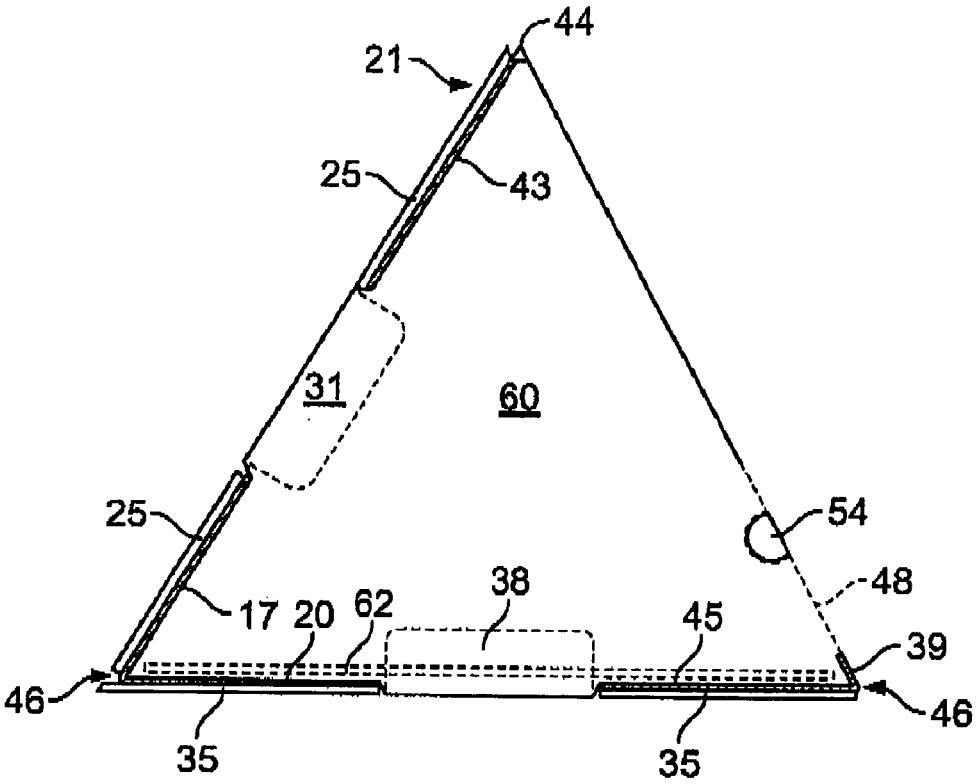
Figure 6:
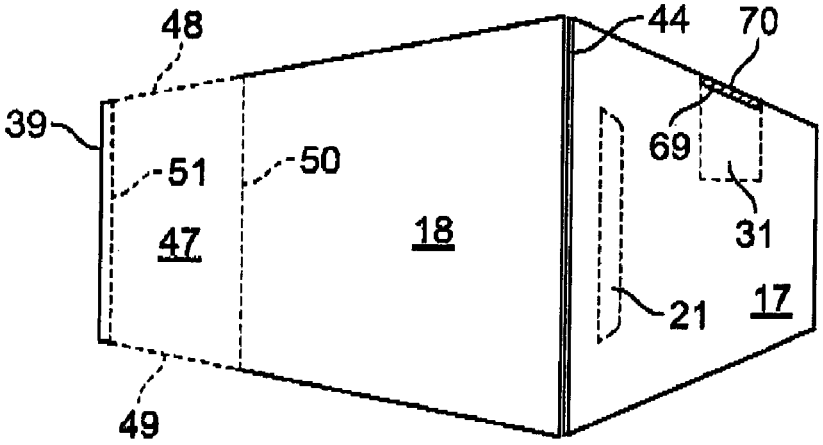
Figure 7:
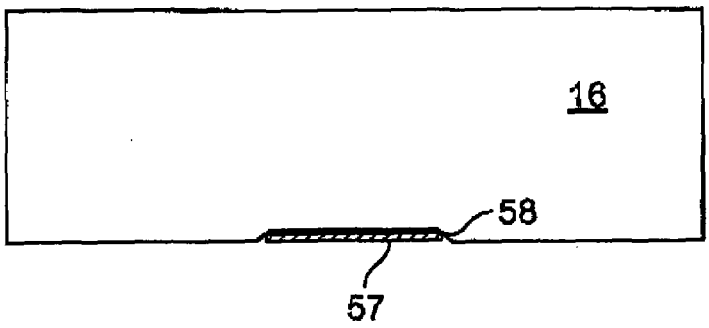
Figure 8:
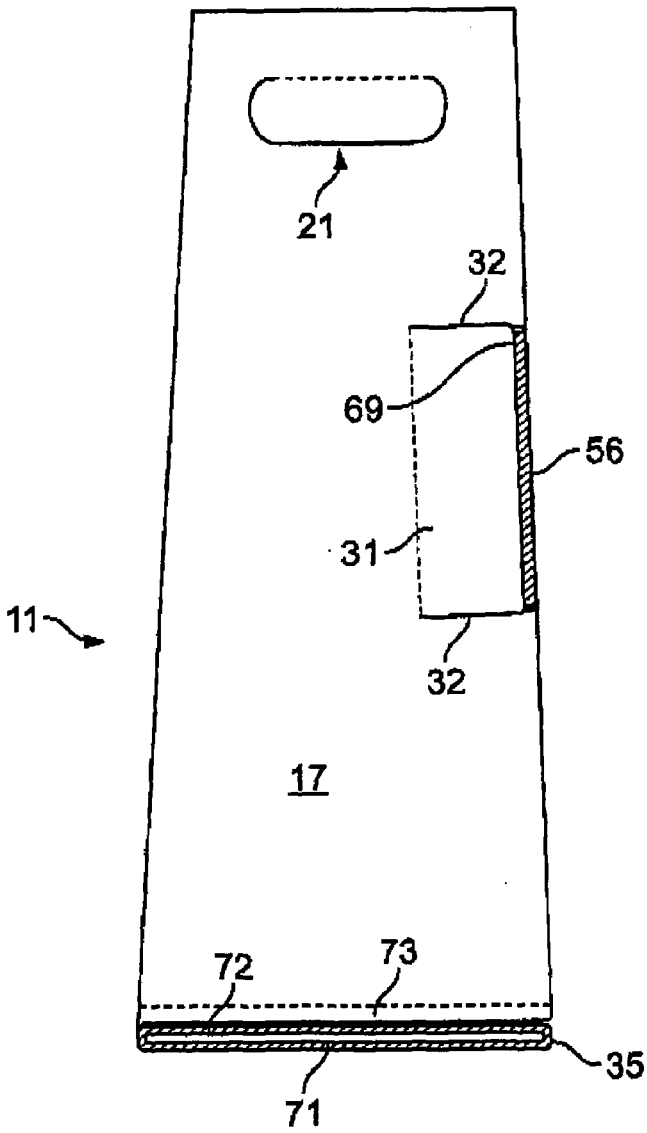
Figure 9:
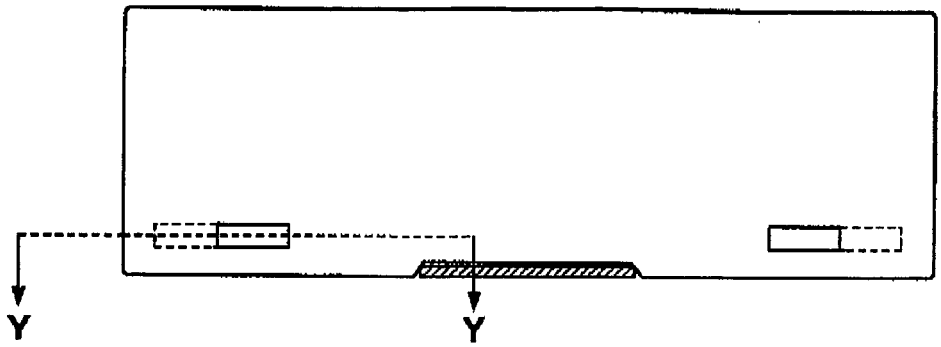
Figure 10:
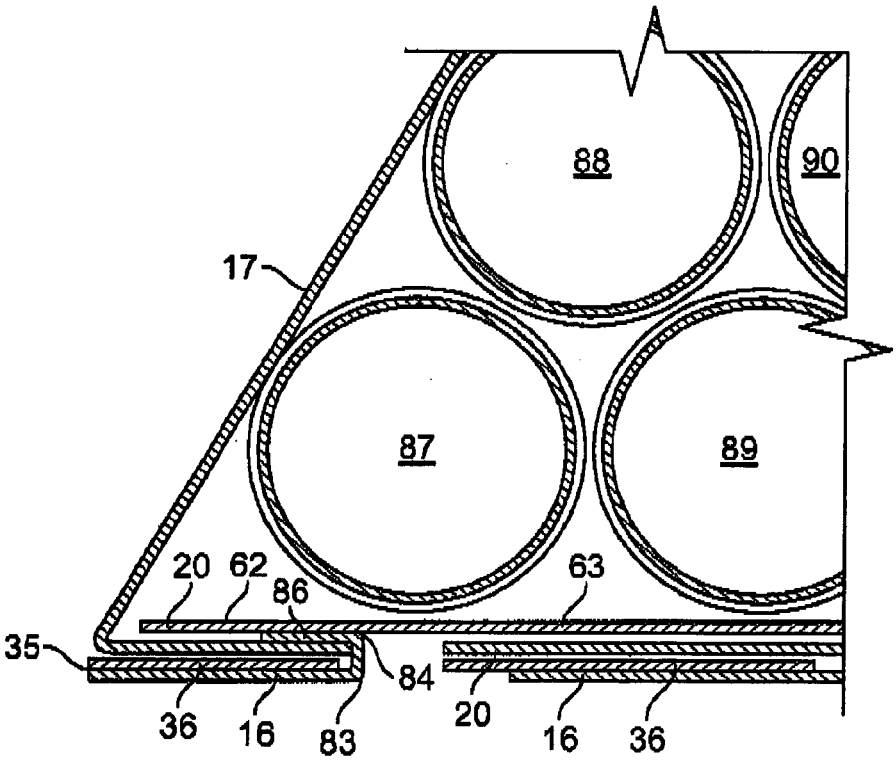
Figure 11:
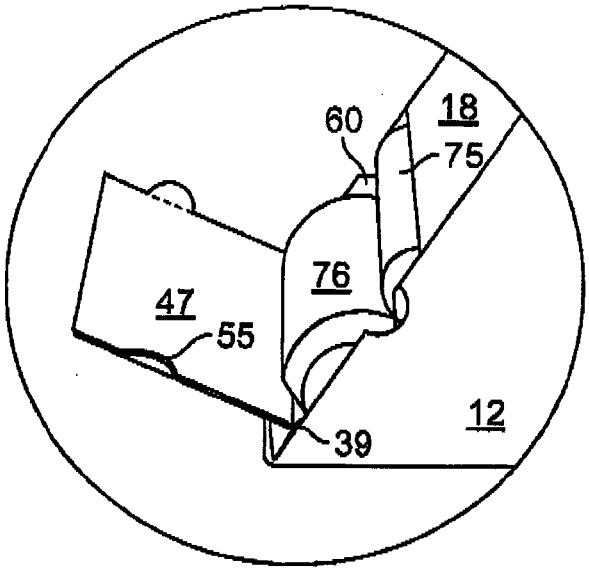
Figure 12:
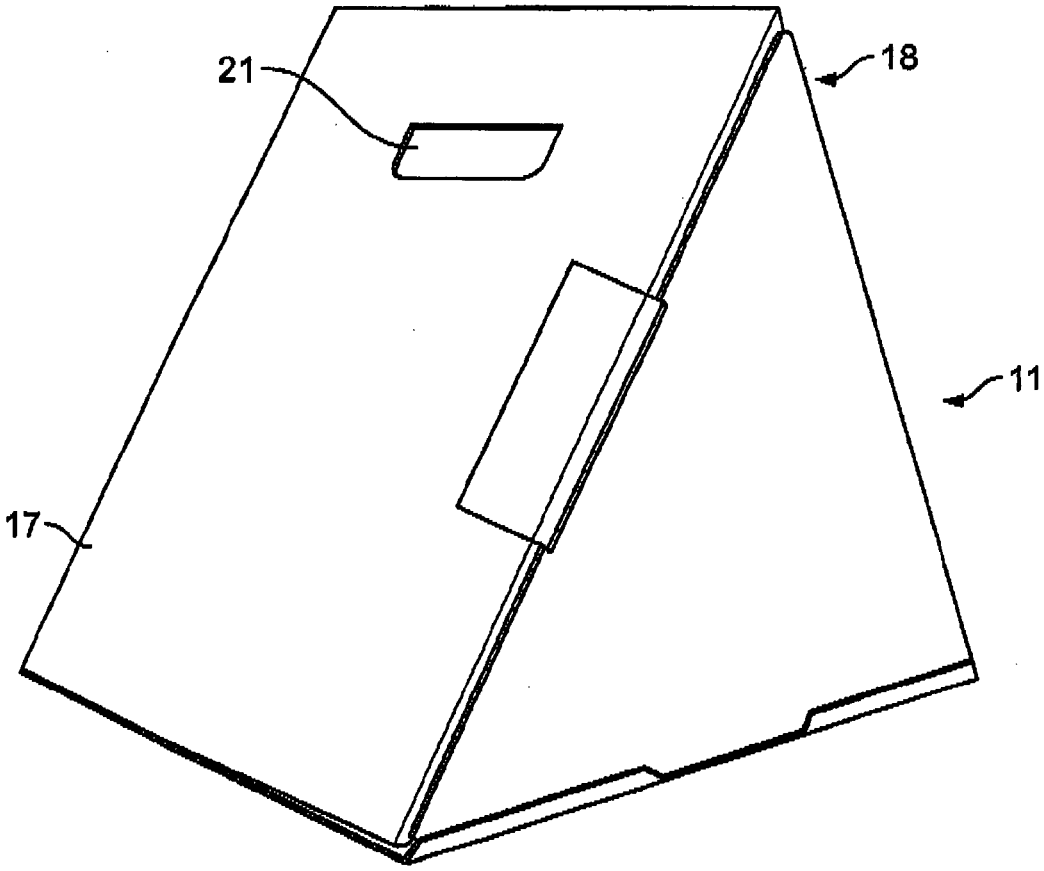
Figure 13:
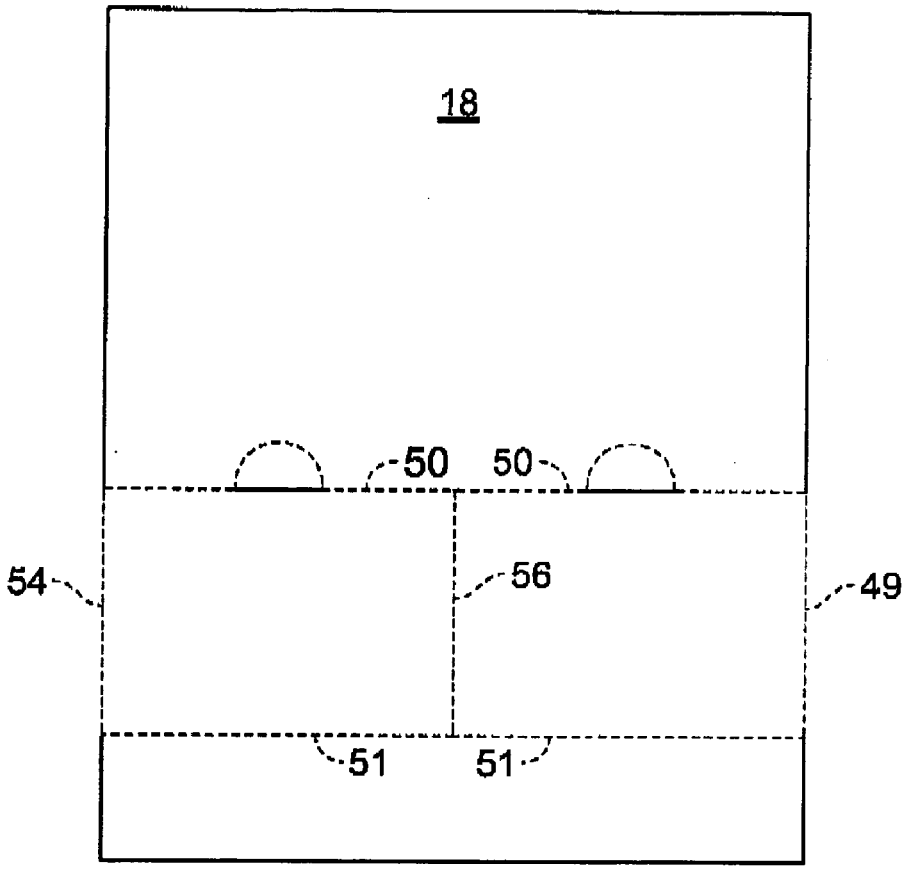
Figure 17:
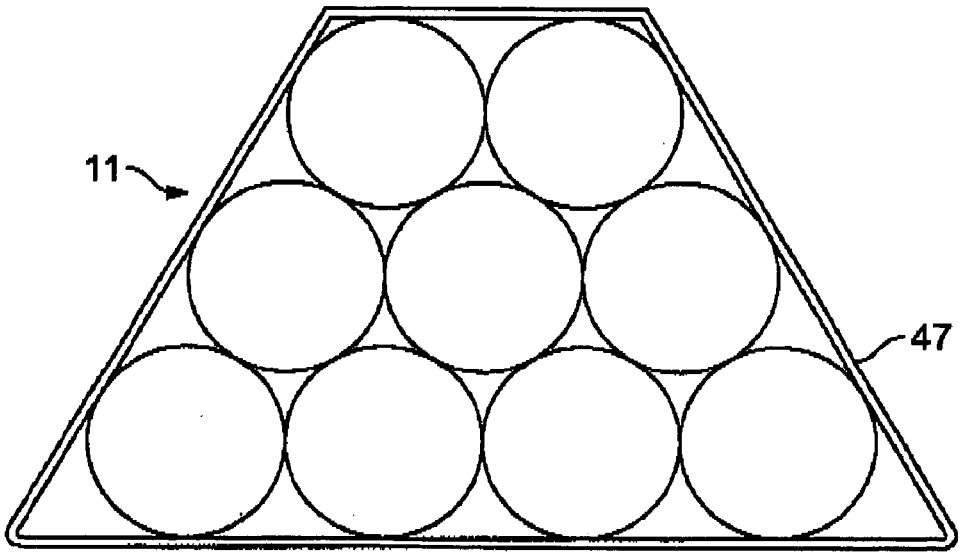
Figure 14:
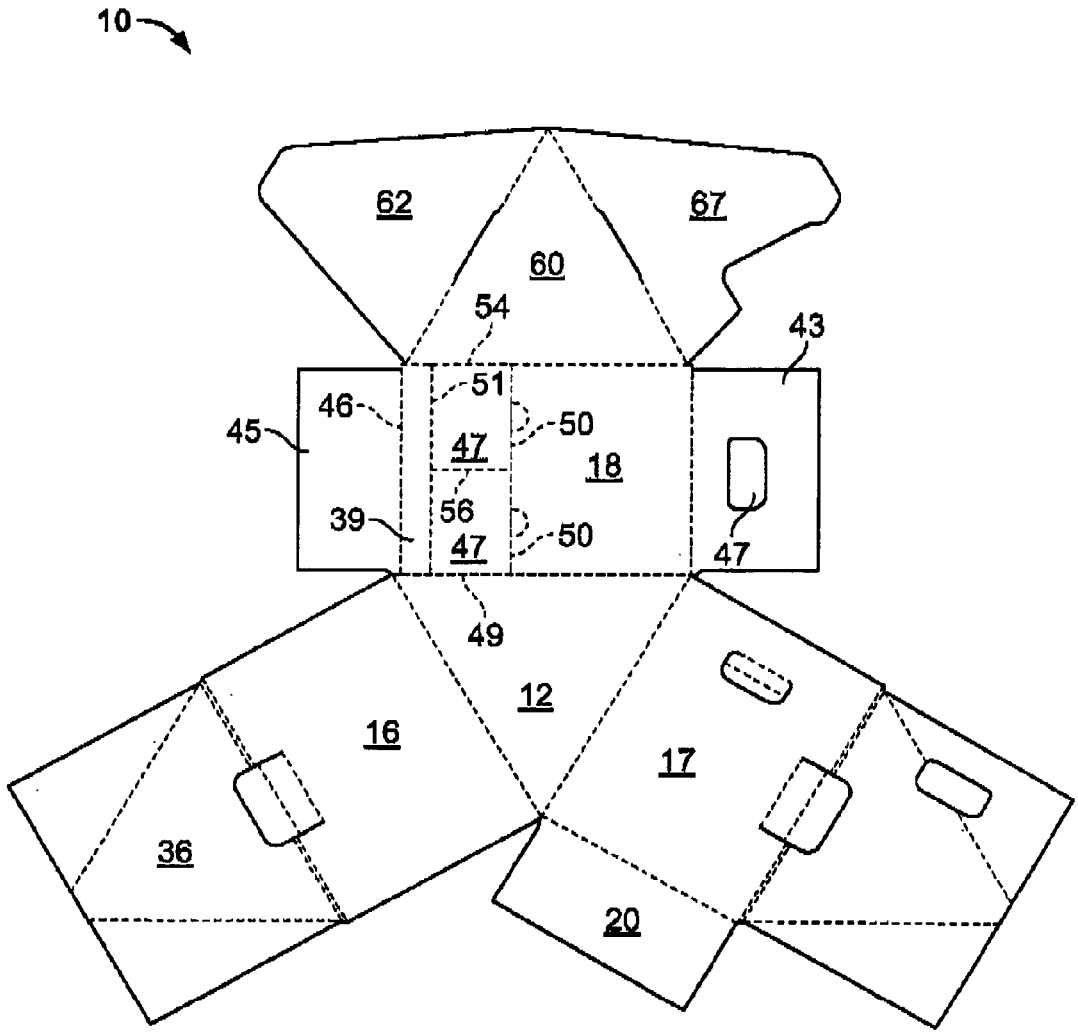
Figure 15:
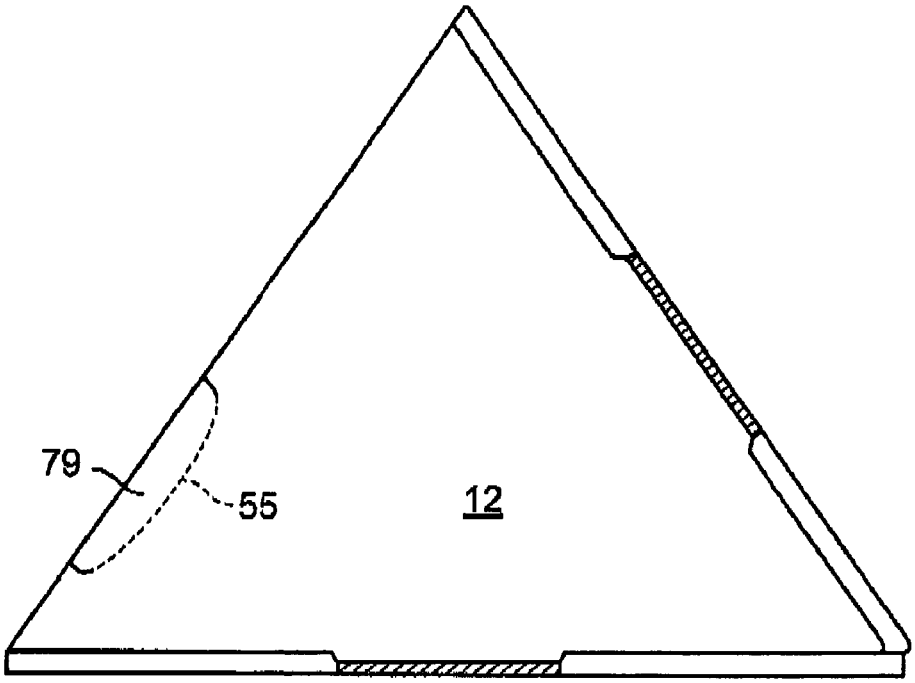
Figure 16:
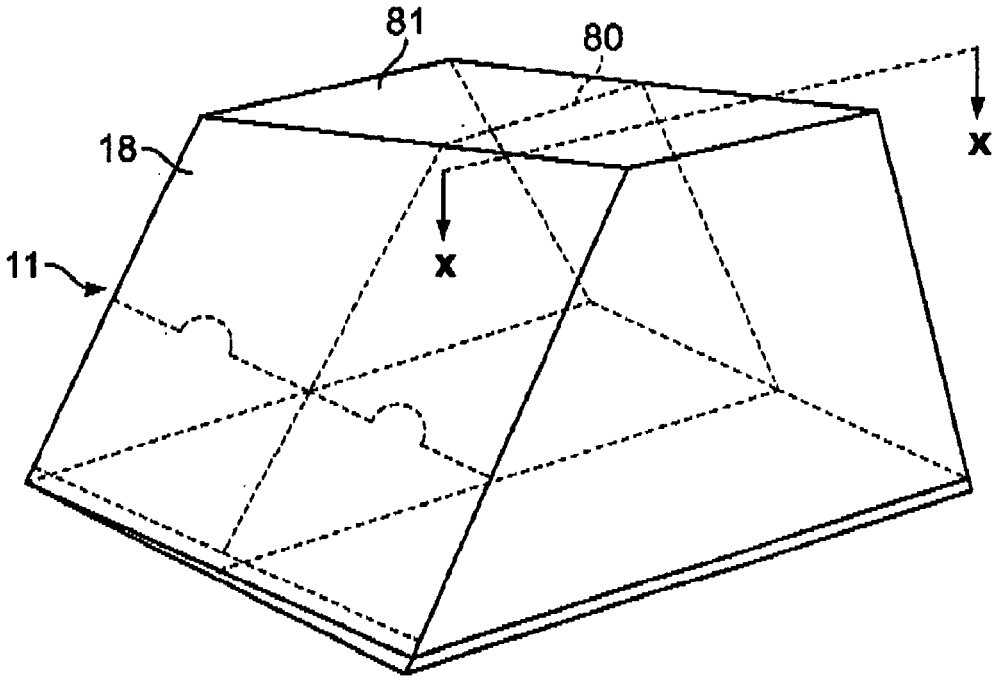

NOTE: In the following FIGS, the access panel is in a closed condition;

FIG. 4 is a side elevational view of the carton of FIG. 3 with its second side wall rotated away from the first side wall to reveal a full complement of cans;

FIG. 5 is one side elevational view of the erected carton of FIG. 3;

FIG. 6 is a top plan view of the erected carton of FIG. 3;

FIG. 7 is a bottom plan view of the erected carton of FIG. 3;

FIG. 8 is one end elevational view of the erected carton of FIG. 3;

FIG. 9 is a bottom plan view of an erected carton formed from the blank of FIG. 2;

FIG. 10 is a part cross-sectional view taken along the line Y—Y in FIG. 9;

FIG. 11 is a detail of the carton dispensing structure of the carton of FIG. 3;

FIG. 12 is an angled perspective of a further carton embodiment of the present invention wherein the carton interior being divided into two adjacent chambers each adapted to enclose one bank of fifteen cans;

FIG. 13 is a blank for forming the carton of FIG. 12;

FIG. 14 is a blank for forming the carton of FIG. 12;

FIG. 15 is a side elevation of a carton similar to that of FIG. 12 but wherein the can access doors are provided with extension flaps;

FIG. 16 is an angled perspective diagrammatic view of a further embodiment of a carton of the present invention, the carton having trapezium side walls and an interior divided into two chambers by a partition;

FIG. 17 is a cross-section along with the X—X in FIG. 16 showing one of the two banks of nine cans enclosed within the carton.

Figure 1:
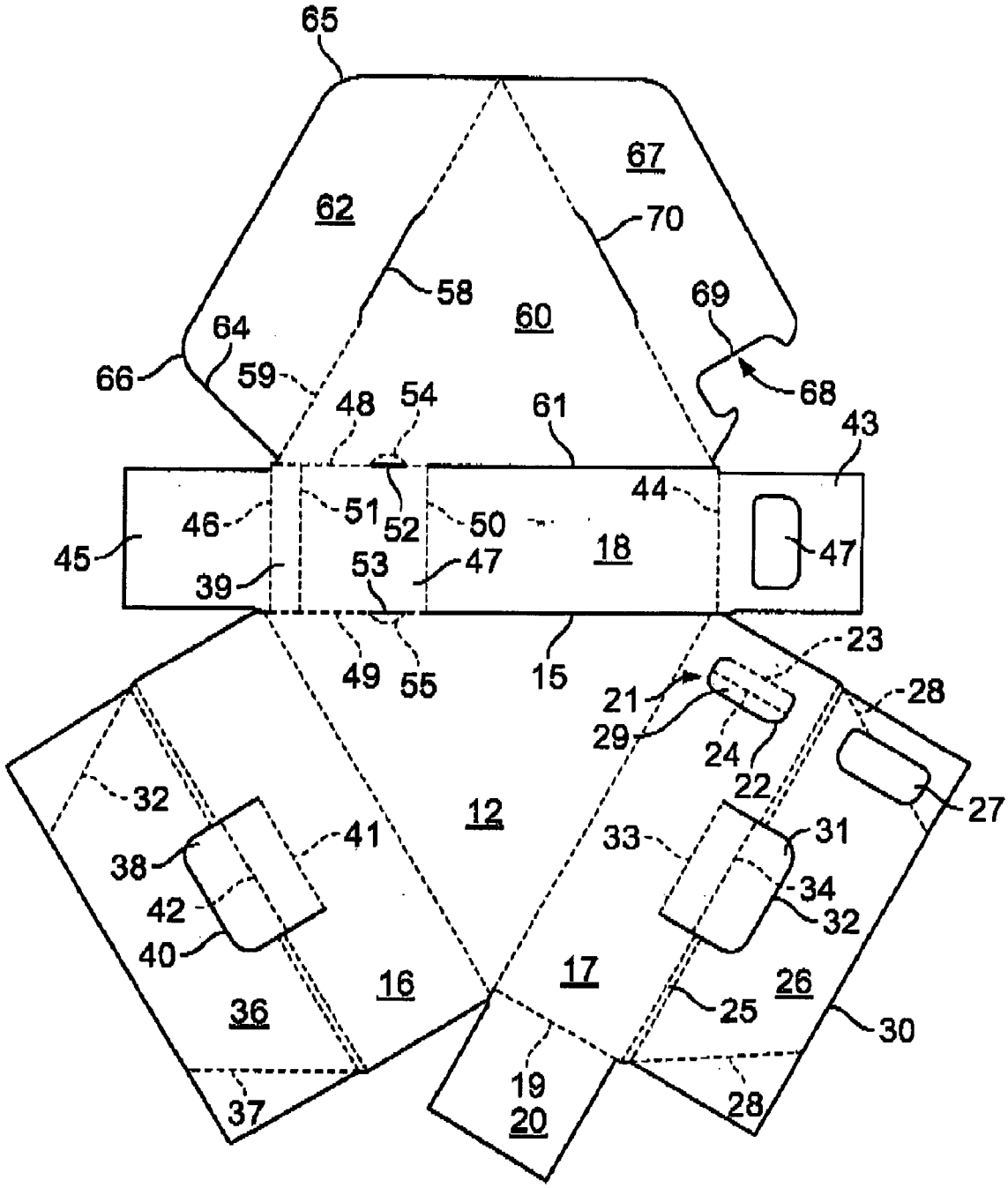
FIG. 1 is a plan view of a paperboard blank adapted to be formed into a carton in accordance with the teachings of the present invention.

For simplicity, similar elements in the various FIGS. Are referred to by the same number. With reference to FIG. 1, this shows a carton blank, generally designated 10, which includes a first side wall 12 which takes the form of an equilateral triangle. Attached to side wall 12 via hinge lines, 13, 14 and 15 respectively are rectangular end walls 16, 17 and 18. End wall 17 has a potential handhole 21 defined on three sides by lines of perforations 22 and on the fourth by score or hinge line 23 and initially sealed by flap 29. A further hinge line 24 extends laterally across the flap 29. End wall 17 is extended by a first tuck flap 20 attached thereto via hinge or fold 19. Extending longitudinally along the other edge of panel 17 is hinge line 25 attached to which is a rectangular panel 26, having a length slightly less than that of end wall 17 and a cutout 27 corresponding to the size and shape of handhole 21. Also provided are two score lines 28, each of which, extends from hinge line 25 to the lateral outer edge 30 of panel 26. Panel 26 is also provided with a locking tab 31 defined by cut line 32 and hinge line 33 which tab actually bridges end wall 17 and panel 26, tab 31 also having a fold line 34 which, essentially, is a part of hinge line 25.

A second and approximately similar end wall structure extends from hinge line 13 of side wall 12, the structure comprising end wall 16, attached thereto by hinge line 35 is panel 36 which has two angled score lines 37. Panel 36 has a length slightly less than that of end wall 16. Tab 38, bridges end wall 16 and panel 36 defined by cut line 40 and hinge line 41 has a centre hinge line 42.

End wall 18, which forms part of the multiple ply base or bottom wall of the erected carton, is extended longitudinally by a first tuck flap 43 foldable along hinge or fold line 44 and a second tuck flap 45 foldable along hinge line 46. Tuck flap 43 is provided with a cutout of the same size and shape as handhole 21. End wall 18 is provided with a carton dispensing structure comprising an access panel 47 defined by severable lines of perforations or weakness 48, 49 and 50, and score or hinge line 51. Extending laterally from each perforated line 48 and 49 of access panel 47 and connected thereto via hinge or score lines 52 and 53 are respectively, push tabs 54 and 55. A threshold or can retention panel 39 extends the width of flap 45 and between hinge lines 46 and 51.

A second side wall 60, of the same size and shape as the first side wall 12, is attached via hinge line 61 to the longitudinal edge of end wall 18. A further panel 62 is attached to a side of second side wall 60 via hinge line 59, this panel being generally rectangular but with its shorter ends 63 and 64 being angled to its longitudinal axis and rounded at the corners 65 and 66. Located approximately midway along hinge line 59 is a lock slot 58. Attached to the remaining edge of second side wall 60 is panel 67 of similar shape and dimensions as panel 62 but which, in addition, is provided with a cut-out 68 defined by cut line 69 the shape being part of the shape of handhole 21. It is also provided with corresponding locking slot 70. The blank is made of a paperboard or similar material especially a corrugated board for increased strength. Turning to the remaining drawings, and not all elements are shown in all the FIGS., there is shown an erected carton, generally designated 11, of the present invention. This comprises two triangular shaped side walls 12 and 60 connected by end walls 16, 17 and 18. It should be noted that end wall 16 is part of the base 19 of the container which comprises multiple plies or layers of paperboard.

Turning to FIG. 2, this shows a modification of the blank shown in FIG. 1 wherein locking slot 69 is provided with a small lateral extension 80. In addition, panel 36 is provided with a base locking tab 81 defined on three sides by perforated line 82 and on the fourth by hinge line 83. A further and double hinge line 84 is provided parallel to and spaced from first hinge line 83. End wall 16 and first tuck flap 20 are each provided with a cut-out 85 equal in size and shape to locking tab 82, such that upon erection of the carton the locking tab 81 and the two cut-outs 85 coincide and tab 81, when folded about hinge line 83 can pass through both cut-outs 85 and further, subsequent to folding about double hinge line 84 the free section 86 of locking tab 81 takes up a position parallel to panel 36 and overlying an inner surface of tuck flap 20, as is shown in detail in FIG. 10.

In FIG. 3 and FIG. 11, can access panel 47 is shown in an open position thereby providing access to cans in the secondary carton 11. Also partly shown in FIG. 3, is locking tab 38 which extends through slot 58, push tabs 54 and 55 partially separated or severed from their associated end walls 60 and 12 and panel 36 which forms part of carton base 19.

In FIG. 4, there is shown the carton of FIG. 3, but with side wall 12 rotated away and displaying the carton contents—in this case 15–355 ml cans of beer. It should be noted that push tab 55 is positioned adjacent a void or gap 74 between adjacent cans 75 and 76. Consequently, when side wall 62 has been rotated around hinge line 15 toward the reader to close the carton, push tab 55 and its counterpart 54 will be parallel and opposing when looked through the void 74 between adjacent cans 75 and 76. It should also be noted that the small can retention panel section 39 of end wall 18 remains intact—i.e. the hinge lines 46, 61, 51 and 15 defining threshold section 39 are not perforated or otherwise weakened.

Turning to FIG. 5, this side elevation shows side wall 60 and, generally, the position of the locking or securing tabs when in position sealing the carton 11. In detail, side locking tab 31 and base locking tab 38 (both shown in phantom) are positioned through their associated slots 69 and 58 respectively and lie against the inside surface of side wall 12 and 60. Tuck flap 43 is shown folded about hinge line 44 to lie between a surface of panel 26 (not shown—it extends from hinge or fold 25) and a surface of panel 67 with handhole 21 and cut-outs 29 and 68 coinciding.

A first tuck flap 20 is shown folded along hinge or fold 19 so as to lie along a surface of panel 26 (not shown in this FIG. since it extends from hinge or fold 35) and between that surface and a surface of panel 62. Second tuck flap 45 is shown folded along hinge or fold 46 so as to line along and between a surface of panel 26 (not shown in this FIG. since it extends from hinge or fold 35) and a surface of panel 62.

Turning to the top plan view shown in the FIG. 6, end wall 17 has potential handhole 21 and part of locking tab 31, the other part of which has been folded about hinge line 34 and passed through slot 70 in panel 67. The visible edge 70 of side wall 60 is also shown as is fold 44 and end wall 18. Also shown are perforated lines of weakness 48, 49 and 50 and hinge line 51, which define access panel 47. Note that an opening threshold panel 39 defined by hinge lines 15, 61, 51 and 46 extends across the full width of end wall 18 remains integral therewith.

Turning to FIG. 7, this shows end wall 16 which is the lowermost ply of the carton base and edge 57 of side wall 60 which is a wall of slot 58.

FIG. 8 is a side elevation of the erected carton 11 showing end wall 17 with potential handhole 21, part of locking tab 31 which remains in the plane of end wall 17, this being defined by cuts 32, the remainder of tab 31 being engaged in slot 70 in panel 67. Also shown is an edge 56 of side wall 12 which edge forms a wall of slot 69. The structure of part of the multiple ply base 19 of carton 11 is shown and comprises an edge 71 of end wall 16; an edge 72 of panel 36, which panels are connected by join 35 and edge 73 (shown in phantom) of tab 20.

FIG. 11 is a detail side perspective view of the dispensing structure of the present invention. The lines of weakness 48, 49 and 50 partially defining access panel 47 have been severed from the associated side walls 12 and 60 and end wall 18 and panel 47 has been rotated to an open condition revealing enclosed cans of beer 75 and 76.

In FIG. 10 which is a part section through a carton erected from the blank of FIG. 2 and taken along the line Y—Y in FIG. 9 and shows the bottom corner of the carton not involved in the dispensing feature is made up of end wall 17, with its associated tuck flap 20 folded about hinge line 19 so as to lie between the multiple ply combination of end wall 16 and panel 36 folded about hinge 35 and panel 62. The tab 81 is shown with perforated line 82 severed and the tab 81 rotated firstly about hinge line 83 and then hinge line 84 so that the free section 86 of tab 81 lies in a locked position parallel to the multiple ply combination of tuck flap 20, end wall 16 and panel 36 making up the carton base. A similar lock tab/cut-out arrangement is provided at the other end section of end wall 16, panel 36 and in this instance, tuck tab 45.

Also shown are several cans of beer 87 in a stacked or layered position they adopt when in the carton. It can be seen that any tendency of the base to bow or sag under the weight of the contents is additionally resisted by this locking feature. This is especially so since the base 19 is anchored along one full side, namely via hinge 13, and at three longitudinally spaced locations, namely via locking tab 40 and the two locking features along the other longitudinal base edge. Turning to FIG. 12, this shows a triangular carton adapted to contain two rows or banks each comprising nine (9) cans in a 4, 3, 2 configuration. One end wall 17 contains a handhole 21. It should be noted that with the desired configuration, the volume at the apex is actually free or empty providing a space to locate a premium such as a baseball or a phone. In this case, an inner wall made also of board is arranged to extend between the end wall 17 and opposing end wall 18 above the two-can row of cans in the can banks.

Each bank of cans has an associated access port or opening shown closed by panel 47—refer to FIG. 13. These are each defined by lines of perforation 49, 50, 51, 54 and 56 and can be fully separated from the remainder of the end wall 18 in which they are formed. Another embodiment of this carton, shown in FIG. 15 has a different opening design, the cover 47 comprising not only an end wall portion similar to that shown in FIG. 13, but also part of a side wall 12 which is defined by a line of perforations 55. The carton 11 shown in FIG. 12 is assembled from the blank 10 shown in FIG. 14. The blank is virtually identical to that of FIG. 1 and it is numbered in a similar manner. Changes include:

(a) There are two rectangular access panels 47 separated by line of weakness 56; and (b) The size of the various walls are increased, relative to those shown in FIG. 1, to provide the volume for the double bank of cans.

Turning to FIGS. 16 and 17, these illustrate a further embodiment of the invention wherein the carton 11 has a trapezium shape and accommodates two adjacent banks of cans each can lying on its side as previously described. The manner the cans stack in the carton 11 is shown in FIG. 17, and there are two banks of nine cans so that the carton is actually an 18-pack. Shown in phantom in FIG. 16 is partition 80 which consists of a sheet of paperboard. The remaining features of the carton are similar to those as described above for the triangular embodiments and hence it is felt there is not need to describe them further here.

The blank of FIG. 1 is erected to form the carton of FIG. 3 as follows: the perforations 32 and 40 are severed and locking tabs 31 and 41 are, respectively, displaced downwardly out of the plane of panel/end wall combinations 36-16 and 26-17 respectively tuck tabs 43 and 45 are rotated toward the reader about hinge lines 44 and 46 respectively and tab 20 about hinge line 19. Rotation of end walls 16, 17 and 18 about their respective hinge lines 13, 14 and 15 forms a triangular "tray" wherein tuck tab 45 and tab 20 overly the inner surface of end wall 16 and tuck tab 43 overlies the inner surface of end wall 17 with cut-out 47 coincident with potential handhole 21. Panel 26 is then rotated around hinge 25 to overlie the inner surface of end wall 17 and tuck tab 43 therebetween. Panel 36 is then rotated about hinge line 35 so as to overlie the inner surface of end wall 16 thus trapping tuck tab 45 and tab 20 therebetween. It will be appreciated that the score or hinge lines 28 and 37 of panels 26 and 36 respectively allow the corner portions of those panels to deform during this action to slide past the angled end wall to which the associated panel is affixed. For example, rotation of panel 26 about hinge line 25 causes hinge lines 28 to come into play allowing the triangular end sections of panel 26 to rotate partially to allow the remainder of panel 26 to complete the rotation and lie against the inside surface of end wall 17. The said corner sections then return to their original position in the same plane as the remainder of panel 26 and help to lock or jam the panel in place. Formation of the carton has now progressed to that shown in FIG. 4—but without the complement of cans. These, in fact, are now inserted manually until a full complement of 15 has been inserted. It should be noted that with the desired number of standard 355 ml cans, and in the pyramidal layered configuration, the carton has an equilateral shape having three equal sides of about 40 cm a side. To complete assembly of the closed carton second end wall 60 is then rotated about hinge 18 and, following rotation of panel 62 about hinge 59 and panel 67 about hinge 68, those two panels are inserted between the side of the cans and associated panels 36 and 26 at which point, the two side panels 12 and 16 are parallel. To lock the carton, locking tabs 31 and 41 are each bent along their associated central hinge line 34 and 42 and the outer section of each tab inserted through the associated locking slot 70 and 58 respectively. Erection of the fully closed carton containing a full complement of 15 cans is now complete.

To activate or create the handhole, it is only necessary to sever line of perforations 22, force with the hand the panel 29 through the underlying cut-outs 27, 47 and 67 whereupon, the lower i.e. free section of panel 29 rotates about hinge 24 to provide a flat "cushioned" holding surface. To open the carton and access the cans, the carton is sat on its base 19 and each of the push tabs 54 and 55 are pushed into the carton 11. It will be noted—refer to FIG. 4—that these tabs are positioned so that they lie opposite the void 74 existing between the two cans located in the carton immediately behind access panel. Consequently, there is nothing to hinder the severing of the lines of perforation defining the tabs and rotating same into the carton. It is then a simple matter by pulling on the access panel 47 to sever the remainder of the perforations 49 and 50 defining the access panel 47 and lifting the latte, rotating same about hinge line 57 to take up the position shown in FIGS. 3 and 11. The lowermost can, under the influence of the cans in the upper layers, immediately moves sidewards until it is stopped by threshold panel 39. As provided by the present invention, the access opening is angled since it is located in side wall 18 which is affixed to bottom 19 at an angle of 60°. This allows can 76 to move about 2 cm into the opening which allows it to be readily and conveniently removed by hand. However, ease of can removal can be further enhanced if the cover 47 has a component from a side wall such as 79 shown in FIG. 15. It should also be noted that the retention panel 39 prevents the next can which replaces 76 from exiting the carton without assistance. When the desired cans have been removed, access panel 47 can be rotated to its original condition to close the opening and be frictionally held in place.

In a similar fashion to that described above, the carton of FIGS. 12 and 15 are formed from the blank shown in FIG. 14. The carton of FIG. 15 is formed from the blank of FIG. 14 but with minor changes, as shown in FIG. 15, to the can access opening. The carton shown in FIGS. 16 and 17 is formed from a blank similar to that shown in FIG. 14 but with obvious changes to the portions of the end and side walls so that the top 81 is formed upon carton erection.

The operating features of this carton are activated in a similar manner to that described above for the triangular embodiments of the invention.

The present invention has been described in detail with reference to its use in packaging a beverage and, in particular, beer. However, its general applicability for other articles are items which are contained in multi-packs but are used individually will be apparent.

The invention claimed is:

1. A triangular package comprising a carton enclosing a space between generally parallel sidewalls disposed in mutually spaced apart relation between two upstanding end walls and a base wall, each end wall being joined to said base wall at an opposing corner and to each other at a third corner, the enclosed space containing a plurality of cans each having a cylindrical wall, said plurality of cans arranged in a mutually stacked relation in a triangular array supported on sides of said cans by said base wall with the array of cans being arranged in fitted relation between the carton sidewalls and the end walls such that: each can has mutually opposed ends positioned in generally co-planar relation with, and adjacent to, a corresponding one of said side walls, and a plurality of said cans located along a periphery of the array are arranged with their corresponding cylindrical walls in contacting relation with adjacent of said carton walls, the cylindrical wall of each can located at a lower corner of the array being constrained between one of said carton end walls and the base wall forming a corresponding one of said opposing corners, with one of the carton upstanding end walls having provision therein for an opening therethrough into the enclosed space, said opening is proximal to but spaced upwardly from the one of said opposing corners formed by the one upstanding end wall and the base wall to form a panel that, with the carton positioned in supported relation on the base wall, restrains any of said cans at the corresponding corner of the array from unassisted egress from the closed space and said opening being sized and positioned to expose only one of said cans located in said associated corner of said carton for the selective removal thereof; and to otherwise interfere with the passage of any more than one of said cans at a time from said enclosed space through said opening, the base wall being free of any obstruction, other than an intervening one of said cans, which would interfere with another of said cans on said base wall moving toward said opening.

2. The package according to claim 1 wherein said carton is a secondary carton enclosing said plurality of cans.

3. The package according to claim 2 wherein the plurality of cans are filled beverage cans.

4. A package according to claim 1, wherein the triangular array has supporting and supported tiers comprising n and n−1 cans respectively, whereupon supported cans in one of said supported tiers engage in nested relation between supporting pairs of said cans in an adjacent one of said supporting tiers.

5. A package according to claim 4 wherein the array takes the form of an equilateral triangle container 15 articles in a 1, 2, 3, 4, and 5 tier configuration.

6. A package according to claim 1 wherein said opening is initially sealed by an article access panel.

7. A package according to claim 6 wherein said article access panel is adapted to be only partially severed from said carton to provide for a hinged connection between said carton and said article access panel whereby said opening can be selectively opened and closed by said article access panel.

8. The package according to claim 1 wherein one of the carton end walls is provided with a handhole.

* * * * *